US008056520B2

(12) United States Patent
Elendt et al.

(10) Patent No.: US 8,056,520 B2
(45) Date of Patent: Nov. 15, 2011

(54) VALVE DRIVE OF AN INTERNAL COMBUSTION ENGINE

(75) Inventors: Harald Elendt, Altendorf (DE); Andreas Nendel, Hessdorf (DE)

(73) Assignee: Schaeffler KG, Herzogenaurach (DE)

( * ) Notice: Subject to any disclaimer, the term of this patent is extended or adjusted under 35 U.S.C. 154(b) by 265 days.

(21) Appl. No.: 12/532,465

(22) PCT Filed: Feb. 19, 2008

(86) PCT No.: PCT/EP2008/051997

§ 371 (c)(1),
(2), (4) Date: Sep. 22, 2009

(87) PCT Pub. No.: WO2008/116703

PCT Pub. Date: Oct. 2, 2008

(65) Prior Publication Data

US 2010/0101517 A1 Apr. 29, 2010

(30) Foreign Application Priority Data

Mar. 23, 2007 (DE) ..... 10 2007 013 946

(51) Int. Cl.
*F01L 1/30* (2006.01)

(52) U.S. Cl. ..... 123/90.24; 123/90.65

(58) Field of Classification Search .... 123/90.65–90.67, 123/90.24–90.26, 188.1–188.3, 90.1, 188.5, 123/188.8

See application file for complete search history.

(56) References Cited

U.S. PATENT DOCUMENTS

| | | | | |
|---|---|---|---|---|
| 2,841,128 | A * | 7/1958 | Aiken | 123/90.29 |
| 4,411,229 | A | 10/1983 | Curtis | |
| 5,245,957 | A | 9/1993 | Bornstein et al. | |
| 2004/0163615 | A1 * | 8/2004 | Schmidt | 123/90.16 |

FOREIGN PATENT DOCUMENTS

| | | | |
|---|---|---|---|
| CA | 2 357 794 | A | 2/2003 |
| DE | 10 2005 049 774 | Y | 4/2007 |
| EP | 0 302 288 | A | 2/1989 |
| EP | 1 236 889 | A | 9/2002 |

* cited by examiner

*Primary Examiner* — Thomas Denion
*Assistant Examiner* — Daniel Bernstein
(74) *Attorney, Agent, or Firm* — Lucas & Mercanti, LLP

(57) ABSTRACT

A valve drive of an internal combustion engine, which has a reciprocating poppet valve and a spring element which impinges the closed reciprocating poppet valve with force against the action of a valve seat. The force characteristics are substantially independent of the lift characteristics of the reciprocating poppet valve. The spring element is part of a snap-in locking device, which is stationarily mounted in the engine and surrounds the valve stem of the reciprocating poppet valve. The snap-in locking device has snap-in elements arranged in the power flux between the spring element and reciprocating poppet valve. The snap-in elements are supported in the direction of closure of the reciprocating poppet valve on a snap-in surface of the valve stem when the reciprocating poppet valve is closed and on a snap-in surface of the snap-in locking device when the reciprocating poppet valve is open.

11 Claims, 3 Drawing Sheets

VALVE DRIVE OF AN INTERNAL COMBUSTION ENGINE

This application is a 371 of PCT/EP2008/051997 filed Feb. 19, 2008, which in turn claims the priority of DE 10 2007 013 946.4 filed Mar. 23, 2007, the priority of both applications is hereby claimed and both applications are incorporated by reference herein.

FIELD OF THE INVENTION

The invention relates to a valve drive of an internal combustion engine having a lifting disk valve which controls the gas exchange cycle of the internal combustion engine and having a spring means which loads the closed lifting disk valve with a force against a valve seat and the force profile of which is substantially independent of the stroke profile of the lifting disk valve.

BACKGROUND OF THE INVENTION

A valve drive of this type is previously known from DE 199 56 584 A1; in said document, it is what is known as a desmodromic valve system having a lifting disk valve which is actively loaded with a stroke by a tappet of an actuator, not only in the opening direction but also in the closing direction. The valve closing force of the lifting disk valve, which valve closing force is active with respect to the valve seat, is generated by a spring means; although the spring force of said spring means is substantially independent of the stroke profile of the lifting disk valve, said spring means is clamped in between the tappet of the actuator and the lifting disk valve and as a consequence moves in its entirety completely with the lifting disk valve. This is true to the same extent of the valve drive which is proposed in U.S. Pat. No. 1,232,352.

In the case of the spring means being coupled to the lifting disk valve in this way, the spring means represents, however, in both cases an additional mass, which is moved completely with the lifting disk valve and conflicts with the general aim in the design of valve drives, namely to minimize their drive and contact forces with a high ability to withstand high rotational speeds.

The constructions which are selected in the above-mentioned documents with regard to the arrangement of the spring means within the desmodromic valve drives also cannot be transferred readily to valve drives of the type, in which the closing movement of the lifting disk valve is not generated actively by an actuator, but rather by the force of a valve spring which is supported at one end in a stationary manner in the internal combustion engine and at the other end on a spring collar which is moved with the lifting disk valve, and which valve spring has, as is known, a force profile which is dependent on the stroke profile of the lifting disk valve. An additional spring means which is substantially independent of the stroke profile of the lifting disk valve can thus be expedient or required, if it is a lifting disk valve which can be deactivated and if its deactivation is based on a spring collar which can be decoupled from the valve stem and can slide to and fro on the valve stem. A valve drive of this type is apparent from DE 195 22 720 A1, an additional valve spring/disk spring arrangement which is connected rigidly to the valve stem being proposed there for supporting the deactivated lifting disk valve with respect to the valve seat in the case of a decoupled, i.e. pressed down spring collar. However, this additional valve spring/disk spring arrangement is to be considered disadvantageous in so far as it also follows the stroke profile of the lifting disk valve completely and thus leads to an undesirable additional installation space requirement, in particular in the longitudinal direction of the lifting disk valve.

OBJECT OF THE INVENTION

The present invention is therefore based on the object of avoiding these depicted disadvantages and therefore of generating a valve closing force of the lifting disk valve which is sufficient with regard to the valve seat, without an increase or at least without a substantial increase of the masses which are moved with the lifting disk valve, with as small an installation space requirement as possible for the spring means. Furthermore, this object is to be achieved for desmodromic valve drives and also for valve drives of the type, in which, although they are of conventional configuration with regard to a valve spring which is stressed and relieved with the stroke profile of the lifting disk valve, a spring collar which can be decoupled from the valve stem and slides to and fro on the valve stem is provided for the purpose of deactivating the lifting disk valve.

SUMMARY OF THE INVENTION

This object is achieved as a result of the characterizing features of claim 1, while advantageous refinements and developments of the invention can be gathered from the subclaims. Accordingly, the spring means is to be part of a latching apparatus which is arranged in a stationary manner in the internal combustion engine, encloses the valve stem of the lifting disk valve and has one or more latching bodies which are arranged in the force flow between the spring means and the lifting disk valve and can be displaced transversely with respect to the valve stem. Here, the latching bodies are supported on a latching face of the valve stem when the lifting disk valve is closed and are supported on a latching face of the latching apparatus when the lifting disk valve is open, in each case in the closing direction of the lifting disk valve. To this extent, the force of the spring means is not only substantially independent of the stroke of the lifting disk valve, but is also coupled into the force flow of the lifting disk valve only when the latter is closed, as a result of the stationary arrangement of the latching apparatus in the internal combustion engine. As a consequence, the spring means does not contribute to any increase or at any rate to any substantial increase of the valve drive mass which is moved with the lifting disk valve. Moreover, on account of its functional restriction to the generation of the valve closing force when the lifting disk valve is closed, that is to say without the stroke of the lifting disk valve being taken into consideration, the spring means can be dimensioned in such a way that only the usual valve closing force which is required for reliable sealing of the lifting disk valve with respect to the valve seat is generated, to the benefit of a minimization of axial installation space for the spring means. Accordingly, suitable spring means may also be, in particular, those with a high spring rate, such as disk springs.

As becomes clear using the exemplary embodiments which are explained later, the term "closed" lifting disk valve also includes its stroke position close to the valve seat shortly after leaving and shortly before reaching the valve seat, since, in this transient state between the latching face of the valve stem and the latching face of the latching apparatus, the latching bodies are still or already in active force engagement with the latching face of the valve stem.

There is a particularly advantageous application of the invention, in particular, in a valve drive with a lifting disk valve which can be deactivated, as is also proposed in the document which was cited last. As a result of the latching apparatus, the deactivated lifting disk valve is loaded with a force which is sufficient in the closing direction even in the time interval, in which the spring collar is pressed down with respect to the valve stem and, as a consequence, the force flow which acts in the closing direction is interrupted between the spring collar and the valve stem. In contrast, the activated lifting disk valve is loaded with a force by the spring means and the latching bodies only in the closed state, to be precise for as long as the latching bodies are supported on the stationary latching face of the latching apparatus.

In a development of the invention, the latching bodies are to be configured as balls. These can come from the mass production of rolling bodies as particularly inexpensive components, preferably a plurality of balls distributed uniformly over the circumference of the valve stem being provided.

In relation to the outlay on manufacturing and costs, it is likewise expedient when the latching face of the valve stem is formed by an annular groove on the valve stem.

In one particularly preferred development of the invention, a structural unit is provided which is formed at least from the latching apparatus and a valve seat guide which mounts the valve stem in a longitudinally movable manner, which structural unit is fixed in a valve stem guide bore of the internal combustion engine. Furthermore, a structural unit of this type can have the following features:

a) a sleeve-shaped outer housing which is fixed on its outer circumferential face in the valve stem guide bore;
b) the valve stem guide which is manufactured as a separate component and is fixed on its outer circumferential face in a first inner circumferential face section of the outer housing, which first inner circumferential face section is close to the valve seat;
c) the spring means which is configured as a compression spring and is supported on one side, optionally with a spring support part positioned in between, on an end side of the valve stem guide, which end side is remote from the valve seat, and on the other side on a pressure piece which is arranged between the compression spring and the latching bodies, which pressure piece is mounted in a longitudinally movable manner in a second inner circumferential face section of the outer housing, and
d) the latching face of the latching apparatus which is formed by a shoulder which adjoins the second inner circumferential face section and extends radially inward with respect to the latter.

As an alternative to this, there can also be provision, however, for the valve stem guide and the outer housing not to be joined as separately manufactured components, but rather for them to be manufactured as a single piece component. As will also become clear using the exemplary embodiments of the invention which will be described later, the radially inwardly extending shoulder can also either be configured as a component which is manufactured separately from the outer housing or can be formed integrally on the outer housing.

For the required sealing action of the valve stem with respect to the associated inlet or outlet channel of the internal combustion engine, there is provision, moreover, for a cut having a valve stem seal which is arranged in it and bears against the valve stem to extend on that end side of the valve stem guide which is remote from the valve seat.

Moreover, the pressure piece is to be manufactured as a thin-walled sheet metal molding to the benefit of low manufacturing costs and a low radial installation space requirement of the structural unit, and is to be formed in a cup-shaped manner with a pressure piece shroud which encloses the compression spring in sections and is mounted in a longitudinally movable manner in the second inner circumferential face section of the outer housing and with a pressure piece base which serves firstly as a spring support and secondly as a latching body support.

In order to stabilize the longitudinal guidance of the lifting disk valve, it is likewise expedient when the structural unit comprises a further valve stem guide which is arranged spaced apart from the valve stem guide, it being intended for the latching apparatus to extend between the valve stem guide and the further valve stem guide.

In a first embodiment of the structural unit in this regard, there is provision for the further valve stem guide to be configured as a cap which is placed on the end side onto the outer housing and has a stepped diameter, which cap reaches around the outer circumferential face of the outer housing with a first axial section of large diameter and has a second axial section of small diameter with an inside guide face for the valve stem and with an outside receiving face for a valve stem seal which bears against the valve stem.

In a second embodiment of the structural unit which is an alternative to this, the further valve stem guide is to be configured as an annular piece which is inserted with its outer circumferential face into an end-side third inner circumferential face section of the outer housing and has an inside guide face for the valve stem.

As long as it is possible or expedient, it goes without saying that a person skilled in the art is also at liberty to combine the features of the invention which are mentioned previously and in the following text with one another as desired.

BRIEF DESCRIPTION OF THE DRAWINGS

Further features of the invention result from the following description and from the drawings, in which a valve drive according to the invention is shown using exemplary embodiments, in each case in a detail which is significant for the understanding of the invention. As long as not otherwise denoted, identical or functionally identical features or components are provided here with identical designations. In the drawings.

DETAILED DESCRIPTION OF THE DRAWINGS

Figure 1:
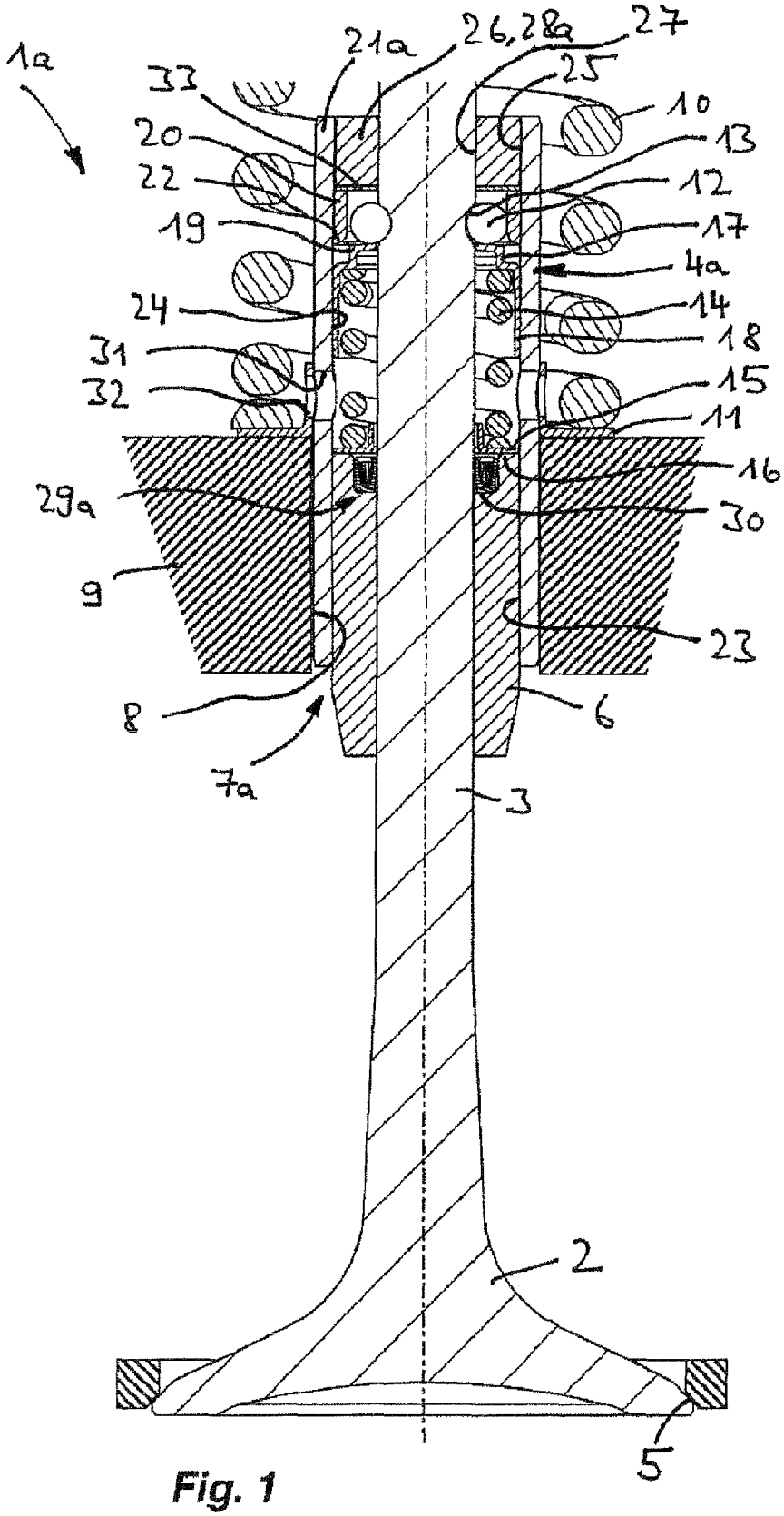
FIG. 1 shows a valve drive according to the invention in a longitudinal section through a first refinement of a structural unit with a latching apparatus.

FIG. 1 shows a detail, which is essential for the understanding of the invention, of a first exemplary embodiment of a valve drive 1*a* of an internal combustion engine having a lifting disk valve 2 which controls the gas exchange of the internal combustion engine and having a latching apparatus 4*a*, which encloses its valve stem 3. The lifting disk valve 2 is currently situated in its closed position, that is to say it bears in a known way sealingly against a valve seat 5 which is mounted in a stationary manner in the internal combustion engine. Together with a valve stem guide 6, which mounts the valve stem 3 in a longitudinally movable manner, the latching apparatus 4*a* forms a structural unit 7*a* which is fixed in a valve stem guide bore 8 of a cylinder head 9 (only indicated here) of the internal combustion engine by means of a press fit connection which is only light but permanent. A valve spring 10 which is arranged concentrically with respect to the structural unit 7*a* is supported at one end on the cylinder head 9 by means of a valve spring support 11 and is supported at the other end on a spring collar (not shown here) which slides to and fro on the valve stem 3 when the lifting disk valve 2 is deactivated, as is proposed, for example, in DE 195 22 720 A1 which is cited at the beginning. The lifting disk valve 2 which is decoupled from the closing force of the valve spring 10 in the time interval while the spring collar slides on the valve stem 3 is held against uncontrolled lifting from the valve seat 5 and sufficiently sealingly on said valve seat 5 by the latching apparatus 4*a* which will be explained in greater detail in the following text.

For this purpose, the latching apparatus 4*a* has three latching bodies 12 which are configured as balls, are arranged distributed uniformly over the circumference of the valve stem 3 and are supported, when the lifting disk valve 2 is closed, on a latching face 13 of the valve stem 3, which latching face 13 is configured as an annular groove. The latching face is of arcuate configuration in order to minimize the contact pressures with respect to the balls 12; what is known as a pointed profile is also to be included in the arcuate shape, which pointed profile is composed, with regard to contact points which are free of edge loading, of two radii with offset center points in the longitudinal direction of the valve stem, which radii are somewhat larger than the ball radius. As can be seen from FIGS. 2 and 3, the arcuate shape can also comprise a cylindrical section which extends between two circular arcs.

The closing force which is transmitted from the balls 12 to the lifting disk valve 2 is applied by a spring means 14 which is configured here as a compression coil spring and is supported on one side, with a spring support part 15 positioned in between, on an end side 16 of the valve stem guide 6, which end side 16 is remote from the valve seat 5, and on the other side on a pressure piece 17 which is arranged between the compression coil spring 14 and the balls 12. The pressure piece 17, which is manufactured here as a thin-walled sheet metal molding, is formed in a cup-shaped manner with a pressure piece shroud 18 which encloses the compression coil spring 14 in sections and with a pressure piece base 19 which serves firstly as a spring support and secondly as a latching body support. In the closed position of the lifting disk valve 2, the balls 12, which can be displaced transversely on the latching body support, are supported on the outside on a supporting ring 20 which, in this exemplary embodiment, is configured as a component which is manufactured separately from a sleeve-shaped outer housing 21*a* of the structural unit 7*a*, like the valve stem guide 6, and is fixed to an inner circumferential face of the outer housing 21*a*. Furthermore, the supporting ring 20 has a latching face 22 which faces the pressure piece 17 and on which the balls 12 are supported when the lifting disk valve 2 is open and the force flow is then interrupted between said lifting disk valve 2 and the compression coil spring 14, as becomes clear from FIG. 3 which will be explained later.

Proceeding from the valve stem guide 6, the outer housing 21*a*, which serves to hold the structural unit 7*a* together, can be divided into a plurality of sections. The valve stem guide 6 is fixed on its outer circumferential face in a first inner circumferential face section 23 of the outer housing 21*a*, which first inner circumferential face section 23 is close to the valve seat 5. A second inner circumferential face section 24 of the outer housing 21*a* serves for the longitudinally movable mounting of the pressure piece 17, while an annular piece 26 is inserted with its outer circumferential face in an end-side third inner circumferential face section 25. Said annular piece 26 serves together with an inside guide face 27 for the valve stem 3 as further valve stem guide 28*a*. In FIG. 1, furthermore, a valve stem seal 29*a* can be seen which bears against the valve stem 3 and is arranged in a cut 30 on that end side 16 of the valve stem guide 6 which is remote from the valve seat 5. Furthermore, bores 31 and 32, respectively, can be seen which extend in the outer housing 21*a* and in the valve spring support 11 and serve for ventilating the spring means chamber between the pressure piece 17 and the spring support part 15 when the lifting disk valve 2 is activated.

Finally, there is provision for the structural unit 7*a* to be machined to its finished state before it is mounted in the internal combustion engine. This takes place in such a way that first an assembly which comprises the outer housing 21*a* and the valve stem guide 6 is machined to its finished state and subsequently the valve stem seal 29*a*, the spring support part 15, the compression coil spring 14, the pressure piece 17, the balls 12, the supporting ring 20 and the further valve stem guide 28*a* with a guide face 27 which is, at this point, not machined yet, are inserted into the outer housing 21*a*. The concentricity of the two valve stem guides 6 and 28*a* which is required for precise guidance of the valve stem 3 is achieved by subsequent machining to the finished state of the guide face 27 of the further valve stem guide 28*a*, penetration of material particles which accumulate during the machining of the guide face 27 with the removal of material into the interior of the latching apparatus 4*a* being prevented by a protective film 33, which is applied to the annular piece 26. Said protective film 33 is perforated in the region of the valve stem 3 which later extends there, only after the machining of the further valve stem guide 28*a* with the removal of material, and the corresponding film waste is pressed out of the further valve stem guide 28*a*.

For the positional securing of the balls 12 when the lifting disk valve 2 has not yet been mounted in the internal combustion engine, a mounting securing means (not shown here) is also provided which corresponds as a dummy to the valve stem 3 with annular groove 13 and is pressed out when the lifting disk valve 2 is guided through the structural unit 7*a*.

Figure 2:
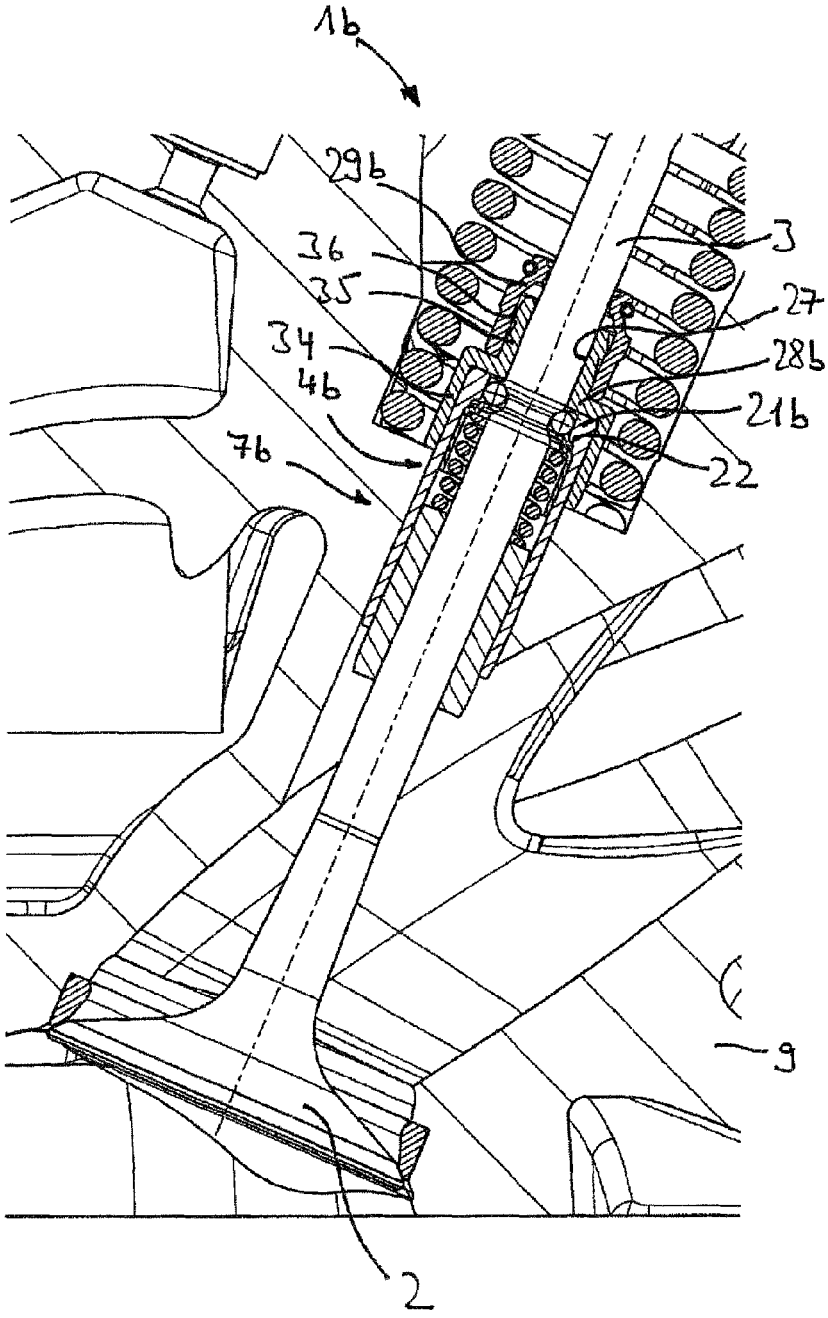
FIG. 2 shows a valve drive according to the invention in longitudinal section through a second refinement of a structural unit with a latching apparatus, with a closed lifting disk valve.
Figure 3:
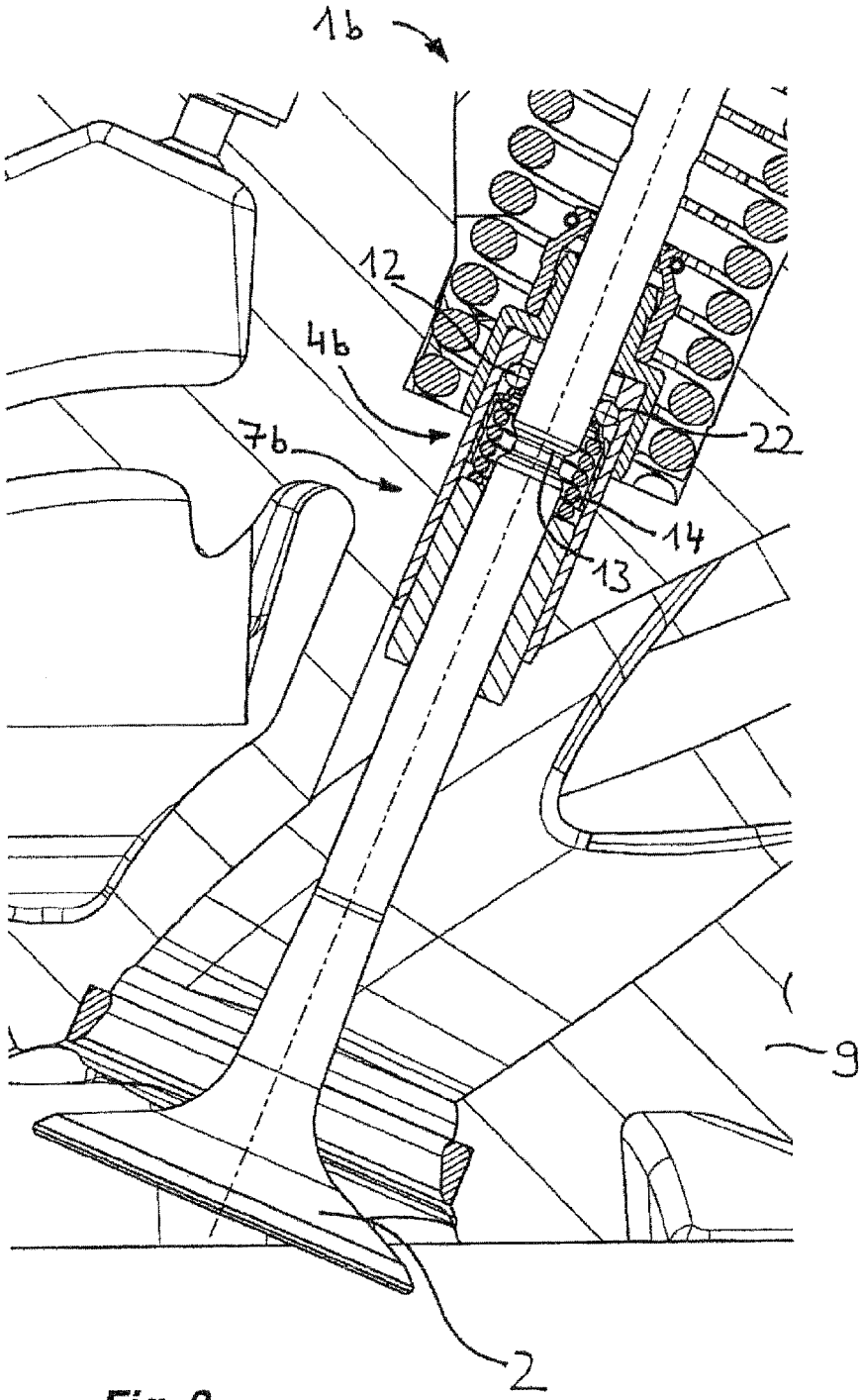
FIG. 3 shows the valve drive according to FIG. 2 with an open lifting disk valve.

FIGS. 2 and 3 show one exemplary embodiment with a substantially identical action of a valve drive 1*b* according to the invention with a structural unit 7*b* of alternative design to FIG. 1 with a latching apparatus 4*b* when the lifting disk valve 2 is closed or open, respectively, in the longitudinal section through the cylinder head 9 of the internal combustion engine. Here, the following explanations are restricted to the function of both latching apparatuses 4*a* and 4*b* and to the structural differences of the structural unit 7*b* with respect to the structural unit 7*a*.

With regard to the function of the latching apparatuses 4*a* and 4*b*, it becomes clear using FIG. 3 that, when the lifting disk valve 2 is open, the balls 12 are no longer supported on the annular groove 13, but rather on the stationary latching face 22, with the result that that force of the compression coil spring 14, which acts in the closing direction, then no longer loads the lifting disk valve 2, apart from friction forces on the valve stem 3. It likewise becomes clear on the axial offset of the annular groove 13 on the valve stem 3 and the position of the balls 12 that the spring travel of the compression coil spring 14 corresponds merely to the marginal stroke of the balls 12, which stroke they travel between the annular groove 13 when the lifting disk valve 3 is closed and the latching face 22 when the lifting disk valve 2 is opening or vice versa when the lifting disk valve 2 is closing. As a consequence, the force profile of the compression coil spring 14 is substantially independent of the stroke profile of the lifting disk valve 2, with the result that, taking into consideration the required closing force of the lifting disk valve 2, the compression coil spring 14 can have a high spring rate with a correspondingly small axial installation space on account of the comparatively small stroke.

One substantial structural modification of the structural unit 7*b* with respect to the structural unit 7*a* which is shown in FIG. 1 comprises firstly the fact that, in this case, the shoulder which extends radially inwardly and serves as a latching face 22 is not formed by the separately manufactured supporting ring 20, but rather is integrally formed on an outer housing 21*b* which is thickened in this region. A further modification of the structural unit 7*b* relates to a further valve stem guide 28*b* which is configured here as a cap which is placed on the end side onto the outer housing 21*b*. Said cap has a stepped diameter and reaches around the outer circumferential face of the outer housing 21*b* with a first axial section 34 of large diameter. An outside receiving face 36 with a valve stem seal 29*b* which is arranged on it and bears against the valve stem 3 extends on a second axial section 35 of small diameter with the inside guide face 27 for the valve stem 3.

| List of Designations | |
|---|---|
| 1a, b | Valve drive |
| 2 | Lifting disk valve |
| 3 | Valve stem |
| 4a, b | Latching apparatus |
| 5 | Valve seat |
| 6 | Valve seat guide |
| 7a, b | Structural unit |
| 8 | Valve stem guide bore |
| 9 | Cylinder head |
| 10 | Valve spring |
| 11 | Valve spring support |
| 12 | Latching body/ball |
| 13 | Latching face/annular groove |
| 14 | Spring means/compression coil spring |
| 15 | Spring support part |
| 16 | End side of the valve stem guide |
| 17 | Pressure piece |
| 18 | Pressure piece shroud |
| 19 | Pressure piece base |
| 20 | Supporting ring |
| 21a, b | Outer housing |
| 22 | Latching face |
| 23 | First inner circumferential face section of the outer housing |
| 24 | Second inner circumferential face section of the outer housing |
| 25 | Third inner circumferential face section of the outer housing |
| 26 | Annular piece |
| 27 | Guide face |
| 28a, b | Further valve stem guide |
| 29a, b | Valve stem seal |
| 30 | Cut |
| 31 | Bore |
| 32 | Bore |
| 33 | Protective film |
| 34 | First axial section of the cap |
| 35 | Second axial section of the cap |
| 36 | Receiving face |

The invention claimed is:

1. A valve drive of an internal combustion engine, comprising:

a lifting disk valve which controls a gas exchange cycle of the internal combustion engine;

a spring means which loads lifting disk valve when closed with a force against a valve seat; and a force profile of which is substantially independent of a stroke profile of the lifting disk valve, wherein the spring means is part of a latching apparatus which is arranged in a stationary manner in the internal combustion engine, encloses a valve stem of the lifting disk valve and has one or more latching bodies which are arranged in a force flow between the spring means and the lifting disk valve and can be displaced transversely with respect to the valve stem, the latching bodies being supported on a latching face of the valve stem when the lifting disk valve is closed and being supported on a latching face of the latching apparatus when the lifting disk valve is open, in each case, in the closed direction of the lifting disk valve.

2. The valve drive of claim 1, wherein the latching bodies are configured as balls.

3. The valve drive of claim 2, wherein a plurality of balls are provided which are distributed uniformly over a circumference of the valve stem.

4. The valve drive of claim 1, wherein the latching face of the valve stem is formed by an annular groove on the valve stem.

5. The valve drive of claim 1, wherein a structural unit is provided which is formed at least from the latching apparatus and a valve seat guide which mounts the valve stem in a longitudinally movable manner, the structural unit being fixed in a valve stem guide bore of the internal combustion engine.

6. The valve drive of claim 5, wherein the structural unit has the following features:

a) a sleeve-shaped outer housing which is fixed on its outer circumferential face in the valve stem guide bore;

b) the valve stem guide, which is manufactured as a separate component and is fixed on its outer circumferential face in a first inner circumferential face section of the outer housing, the first inner circumferential face section being close to the valve seat;

c) the spring means, which is configured as a compression spring and is supported on one side, optionally with a spring support part, positioned in between, on an end side of the valve stem guide, which is remote from the valve seat, and on the other side on a pressure piece, which is arranged between the compression spring and the latching bodies and is mounted in a longitudinally movable manner in a second inner circumferential face section of the outer housing; and d) the latching face of the latching apparatus, which is formed by a shoulder that adjoins the second inner circumferential face section and extends radially inward with respect to the latter.

7. The valve drive of claim 6, wherein a cut having a valve stem seal, which is arranged in it and bears against the valve stem, extends on the end side of the valve stem guide which is remote from the valve seat.

8. The valve drive of claim 6, wherein the pressure piece is manufactured as a thin-walled sheet metal molding and is formed in a cup-shaped manner with a pressure piece shroud which encloses the compression spring in sections and is mounted in a longitudinally movable manner in the second inner circumferential face section of the outer housing and with a pressure piece base which serves firstly as a spring support and secondly as a latching body support.

9. The valve drive of claim 5, wherein the structural unit comprises a further valve stem guide which is arranged spaced apart from the valve stem guide, the latching apparatus extending between the valve stem guide and the further valve stem guide.

10. The valve drive of claim 9, wherein the further valve stem guide is configured as a cap which is placed on the end side onto the outer housing and has a stepped diameter, the cap reaching around the outer circumferential face of the outer housing with a first axial section of large diameter and has a second axial section of small diameter with an inside guide face for the valve stem and with an outside receiving face for a valve stem seal which bears against the valve stem.

11. The valve drive of claim 9, wherein the further valve stem guide is configured as an annular piece which is inserted with its outer circumferential face into an end-side third inner circumferential face section of the outer housing and has an inside guide face for the valve stem.

* * * * *